US005616072A

United States Patent [19]

Walz et al.

[11] Patent Number: 5,616,072

[45] Date of Patent: Apr. 1, 1997

[54] DEVICE FOR CLAMPING SANDPAPER ON A VIBRATING SANDER

[75] Inventors: Heinz Walz, Waldenbuch; Vinzenz Härle, Neckartenzlingen, both of Germany

[73] Assignee: Robert Bosch GmbH, Stuttgart, Germany

[21] Appl. No.: 394,846

[22] Filed: Feb. 27, 1995

Related U.S. Application Data

[63] Continuation of Ser. No. 64,131, filed as PCT/DE91/00829, Oct. 23, 1991, abandoned.

[30] Foreign Application Priority Data

Nov. 23, 1990 [DE] Germany ..... 40 37 266.9

[51] Int. Cl.[6] ..... B24B 23/00

[52] U.S. Cl. ..... 451/356; 451/514

[58] Field of Search ..... 451/356, 514

[56] References Cited

U.S. PATENT DOCUMENTS

| | | | |
|---|---|---|---|
| 2,908,059 | 10/1959 | Domenech et al. | 24/662 |
| 3,375,616 | 4/1968 | Scott et al. | 51/170 TL |
| 4,398,375 | 8/1983 | Malyuk | 51/170 TL |

FOREIGN PATENT DOCUMENTS

| | | | |
|---|---|---|---|
| 566358 | 4/1958 | Belgium . | |
| 3508911 | 9/1986 | Germany | 51/170 MT |

*Primary Examiner*—Joseph M. Gorski
*Attorney, Agent, or Firm*—Michael J. Striker

[57] ABSTRACT

A device for clamping sandpaper to a sanding plate of a vibration sander has a spring-loaded clamping member for holding the sandpaper, the clamping member having a handle part for actuation and being holdable on the sanding plate so as to be swivelably arranged optionally in a clamping position, and disengaged position, the clamping member being formed as a bistable flip-flop mechanism.

9 Claims, 2 Drawing Sheets

DEVICE FOR CLAMPING SANDPAPER ON A VIBRATING SANDER

This is a continuation of application Ser. No. 08/064,131, filed as PCT/DE91/00829 Oct. 23, 1991, and now abandoned.

BACKGROUND OF THE INVENTION

The present invention relates to a device for clamping sandpaper on the sanding plate of an orbital or vibrating sander.

A sandpaper holder for such a vibrating sander is known from U.S. Pat. No. 3,375,616. This sandpaper holder has a slide which is influenced by a spring and guided parallel to the sanding plate and also allows small movements transverse to its principle displacing direction. In the rest position of the slide, its edge contacts a stop face below an actuating handle. In so doing, it releases the clamping member so that the latter can clamp the sandpaper. This slide is pushed in parallel to the sandpaper to move the clamping member out of its clamping position. In so doing, the lower edge of its inner end face meets a bent-up arm of the locking member which is swivelably supported on the sanding plate. The clamping member must now be moved into its lifting position with the slide while overcoming its own spring and the clamping spring of the clamping member. When this position is reached, the operator must move the slide transverse to its displacement direction against the rotating component of the clamping member supported on the slide into a locking position and there fasten it at a stop. The available stop edge is relatively narrow and lies vertically to the displacement direction without an undercut. Thus, this locking is not secure enough because it can easily be disengaged by the handling entailed in fitting the vibrating sander with sandpaper. Even striking it against a work table or unintentionally touching the actuating handle of the slide can cause the slide to spring back. At all events, use of the slide requires a relatively great amount of skill since two differently directed movements against spring action must be executed one after the other. In addition, the relatively great adjusting force which is required must be applied parallel to the sanding plate, i.e. the operator cannot press against a support on which the vibrating sander rests on its sanding plate. This is a considerable additional impediment to handling. Finally, this construction requires a number of individual parts with their own bearings and guides which must be adapted to one another. This entails a high manufacturing cost.

SUMMARY OF THE INVENTION

Accordingly, it is an object of the present invention to provide a device for clamping sandpaper on a vibrating sander, which avoids the disadvantages of the prior art.

In keeping with these objects and with others which will become apparent hereinafter, one feature of the present invention resides, briefly stated, in a device for clamping sandpaper of the above mentioned type in which the clamping member is formed as a bistable flip-flop mechanism.

When the clamping device is designed in accordance with the present invention, it has the advantage over the prior art in that its handling when clamping in and unclamping sandpaper is simpler, lighter and improved with respect to ergonomics. The device has an extremely simple construction and can be realized at a low cost with regard to manufacturing technique, namely by manufacturing it from an individual piece of material in a single work cycle. Also, high clamping forces of the clamping member can be transmitted to the sandpaper with the clamping device according to the invention. The sandpaper is accordingly held in a particularly reliable and secure manner.

In accordance with another feature of the present invention, the flip-flop mechanism can be constructed as a resilient plate which is tensioned at least partially by arching.

In accordance with still another feature of the present invention, the clamping member can be formed as a plate with an elongated, planar sheet metal part having two ends at two longitudinal sides, with central region separated from two outer regions by two openings and being longer than the outer regions. One end of the clamping member can be fastened on the back of the sanding plate, while the other free end can extend along the back of the sanding plate and supported on it in the clamping position. The clamping member can have a plurality of sheet metal pieces.

In accordance with still further features of the present invention, the swivel region of the clamping member can be defined by at least one stop contacting the arched central region of the clamping member. The swivel region of the clamping member can be defined on each swivel side by a lower and/or upper stop. The stops can be supported on opposite sides of the clamping member at its convex central region.

At least one of the stops can be integral with the clamping member constructed as a bending part. The stops can project out of the sanding plate as a tongue, and at least one stop can hold the fixed end of the clamping member on the sanding plate. Also, the side of the sanding plate can carry a sill at its edge in the vicinity of the support point of the free ends of the clamping member, so that the sandpaper is guided along the sill. Finally, the clamping member can carry a separate handle part at its free end.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The invention is described in the following with reference to an embodiment example with relevant drawings.

DESCRIPTION OF THE PREFERRED EMBODIMENTS

Figure 1:
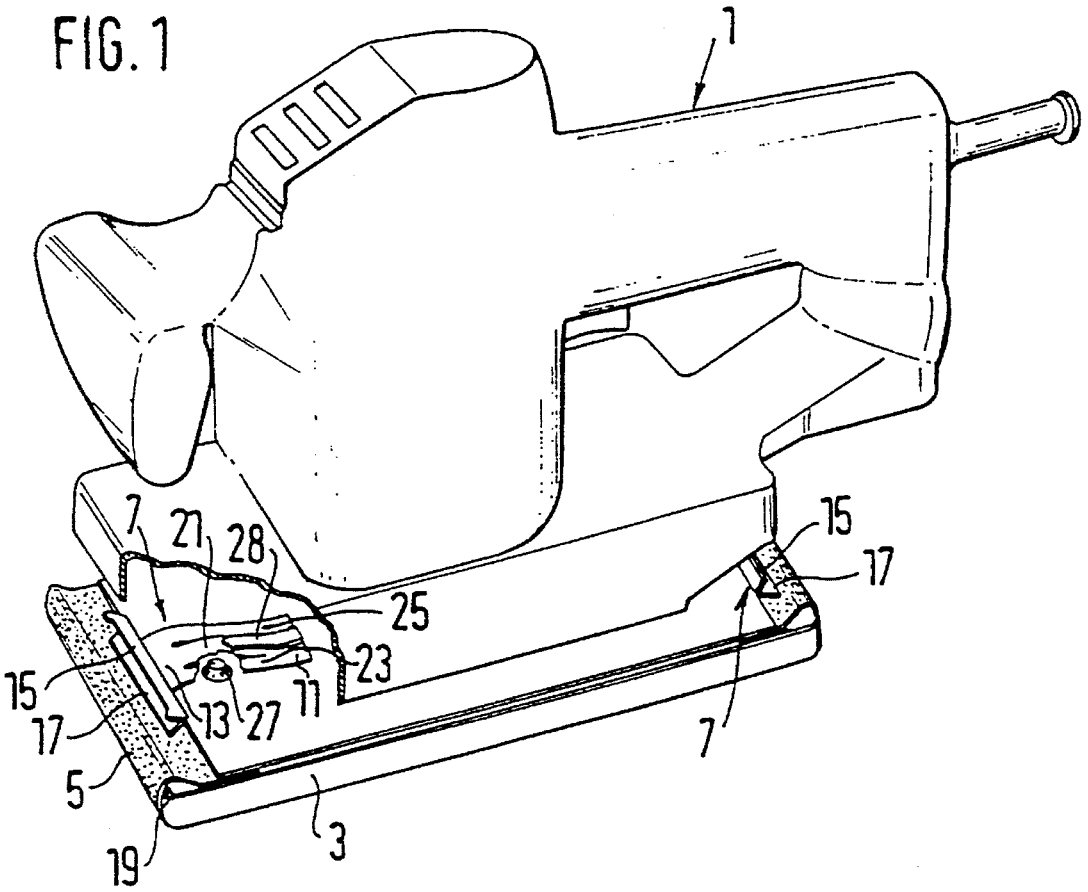
FIG. 1 shows an embodiment example of a vibrating sander according to the invention.

The vibrating sander 1 shown in FIG. 1 has a sanding plate 3 whose lower, free surface carries sandpaper 5. This sandpaper is clamped by its two ends on the back of the sanding plate 3 by means of a clamping member 7.

The clamping member 7 has the shape of a leaf spring which is fastened by one end 11 on the back of the sanding plate 3 in the vicinity of its edge as a bistable flip-flop mechanism, e.g. by riveting, welding, screwing or flanging by tongues which are stamped out of the sanding plate 3. A free end 13 located opposite from the end 11 is divided into two portions. A first portion which projects away from the sanding plate 3 serves as a handle part 15. A second portion which faces the sanding plate 3 serves as a clamping claw 17 for fixing the end of the sandpaper. The outermost edge of the sanding plate 3 is bent up vertically from its horizontal position on two opposite sides at least in some areas and forms a sill 19 along which the sandpaper 5 is guided.

The clamping member 7 has a central area 21 extending lengthwise which is longer than the two outer regions 23, 25 adjoining it and is consequently arched so as to form an element of a flip-flop mechanism, which element is known per se.

A lower stop 27 is arranged on the back of the sanding plate 3 in the vicinity of the center of the central region 21, the central region 21 being supported on this stop 27 in the disengaging position of the clamping member 7.

A leaf-spring type upper stop 28 is fastened on the fixed end 11 of the clamping member 7 on the back of the sanding plate 3 and extends closely adjacent to the clamping member 7 on its side remote of the sanding plate 3. The free end of the upper stop 28 is supported at the convex central region 21 roughly between its center and the handle 15 in the disengaging position as well as in the clamping position.

The clamping member 7 can be swiveled manually into a stable disengaging position or clamping position via the handle part 15. The central region 21 has a convex curve on the side remote of the back of the sanding plate 3 in the clamping position and a concave curve in the disengaged position.

In the clamping position, the clamping claw 17 is supported on the end of the sandpaper 5 against the back of the sanding plate 3. The end of the sandpaper 5 is guided downward a short distance toward the back of the sanding plate 3 via the sill 19. The end of the sandpaper is held particularly securely by means of this additional bend.

The actuating lift at the handle part 15 required for producing the clamping position of the clamping member 7 is curtailed by the lower stop 27. By situating the point of support on the central region 21, the upper stop 28 does not influence the actuating lift at the handle part 15 required for producing the disengaging position of the clamping member 7, but reinforces the clamping force of the clamping member 7 in the clamping position and defines the snapping swivel angle.

Because of the dimensioning and positioning of the upper stop 28, the actuating lift at the handle part 15 required to disengage the clamping position or to produce the disengaging position of the clamping member 7 is greater than that required to produce the clamping position. Accordingly, the clamping position cannot be disengaged as the result of an unintentional impact on the handle part 15 or by catching the handle part 15. An unwanted disengagement of the sandpaper 5 when working with the vibrating sander would damage the sandpaper 5 or the surface to be sanded. It is important to avoid this particularly in difficult working positions, e.g. overhead work, and this is ensured by the clamping device according to the invention.

Figure 2:
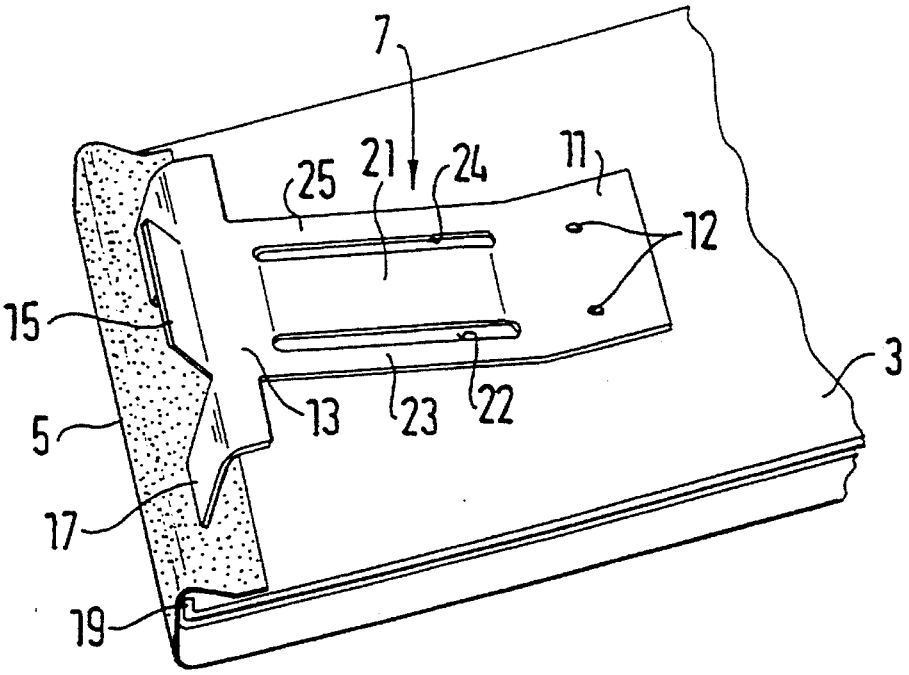
FIG. 2 shows an embodiment example of a sanding plate according to the invention.

FIG. 2 shows a portion of the sanding plate 3 with the clamping member 7 located in the clamping position. The drawing shows particularly clearly how the central region 21 is separated from the outer regions 23, 25 by openings 22, 24. The spot welds 12 at the end 11 of the clamping member produce a solid connection with the sanding plate 3. The parts in FIG. 2 corresponding to those in FIG. 1 are designated by the same reference numbers.

Figure 3:
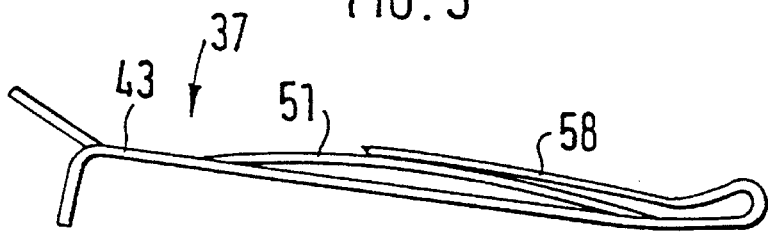
FIGS. 3 and 4 show two embodiment examples of the clamping member.
Figure 4:
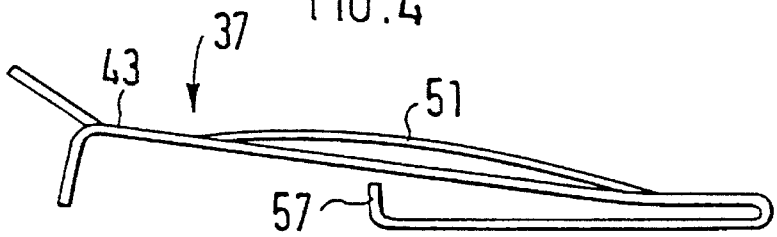

FIGS. 3 and 4 show two embodiment examples of the clamping member 37, each having a free end 43, a central region 51, and a stop 57 or a stop plate 58 as integral bending piece. In this construction the clamping member is simple to produce and is mounted in an advantageous manner.

Figure 5:
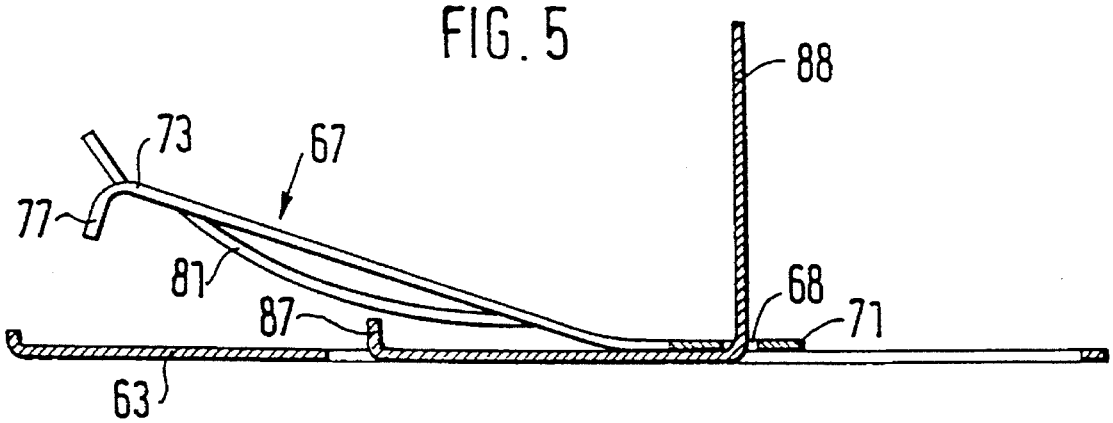
FIGS. 5 and 6 show a further embodiment example of the sanding plate in two production phases.
Figure 6:
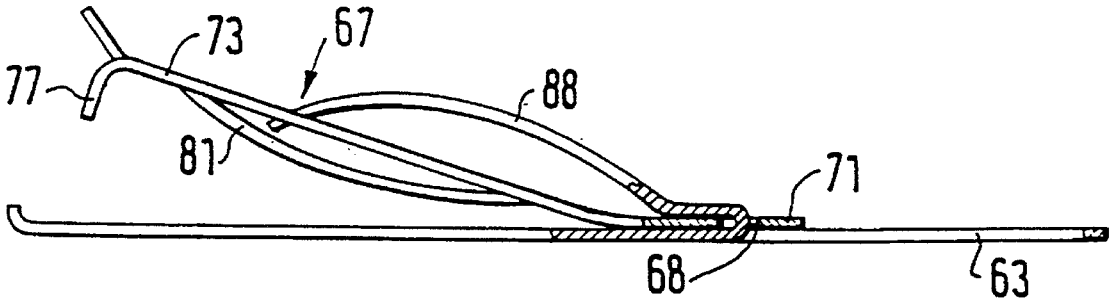

FIGS. 5 and 6, respectively, show an embodiment example of a sanding plate 63 with clamping member 67 in the disengaged position. Stamped tongues forming a lower stop 87 and an upper stop 88 project out of the sanding plate 63. The tongue forming the stop 88 passes through a recess 68 in the clamping member 67 and simultaneously forms a tab of a tab connection for securing the clamping member 67 on the sanding plate 63 and at the same time reinforces its spring force.

The embodiment example according to FIG. 6 has no lower stop. The bent up upper stop 88 in FIG. 5 is shown in FIG. 6 in its end position as a tab connection and is bent toward the free end 73 of the clamping member 67. In the disengaging position, its own free end barely contacts the clamping member 67. At the point where it bends around the recess 68 of the clamping member 67, it secures the fixed end 71 of the latter on the sanding plate 63, although this object could be met by a weld, solder, bead and/or cement connection in other embodiment examples which are not shown in the drawings.

When swiveled into the clamping position, the central region 81 jumps into a convex position relative to the upper stop 88 and is supported thereat. The clamping force at the clamping claw 77 is accordingly increased and the sandpaper is held in a particularly secure manner.

In an embodiment example of the invention which is not shown in the drawing the clamping member is a leaf spring without a central region and with two arched, converging outer regions whose ends carry a clamping claw. The two stops are integral with the clamping member.

In another embodiment example, not shown, the clamping member can be assembled from a plurality of different materials and the handle can be made from injection-molded or cast plastic. The arrangement of the stops is optional in this case.

Further possible embodiment examples can be realized on the basis of the technical teaching of the invention without inventive activity by using bistable flip-flop mechanisms which are generally known and developed in many different forms.

Naturally, clamping devices according to the inventive solution can also be used for any other likely purpose when suitably adapted, e.g. in airplane or boat building for clamping sheet-metal plates or plastic plates to frames prior to fastening or for bundling cables to form cable harnesses.

It will be understood that each of the elements described above, or two or more together, may also find a useful application in other types of constructions differing from the types described above.

While the invention has been illustrated and described as embodied in a device for clamping sandpaper on a vibrating sander, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A clamping device in combination with a sanding plate of a vibration sander, comprising:

a sanding plate of a vibration sander; and a clamping device fastened to said sanding plate, wherein said clamping device comprises:

i) a resilient plate having two longitudinal sides interconnected by two ends, and also having two longitudinally extending openings which separate a central region of said plate from two lateral regions of said plate, wherein said central region is convex and said lateral regions are substantially planar;

ii) at least one stop positioned to contact said central region and change the direction of its convexity;

iii) a handle part located at a first end of said plate for bringing said central region into contact with said at lest one stop;

with a second end of said resilient plate fastened to said sanding plate, such that said resilient plate snap swivels in response to direction of the convexity of said central region from a clamping position in which said first end of said resilient plate is proximate said sanding plate such that sandpaper can be clamped between said first end and said sanding plate, to a disengaged position in which said first end is remote from said sanding plate such that the sand paper can be removed from the sanding plate.

2. The clamping device in combination with a sanding plate of a vibration sander as defined in claim 1; and further comprising a sill located in the vicinity of said first end of said resilient plate so that the sandpaper can be guided over said sill.

3. The clamping device in combination with a sanding plate of a vibration sander as defined in claim 2, wherein said sill is formed as a bent-up end of the sanding plate.

4. The clamping device in combination with a sanding plate of a vibration sander as defined in claim 1, wherein said handle part is separate from said resilient plate.

5. The clamping device in combination with a sanding plate of a vibration sander as defined in claim 4, wherein said handle part is composed of plastic material.

6. A clamping device in combination with a sanding plate of a vibration sander, comprising:

a sanding plate of a vibration sander; and a clamping device fastened to said sanding plate, wherein said clamping device comprises:

i) a resilient plate having two longitudinal sides interconnected by two ends, and also having two longitudinally extending openings which separate a central region of said plate from two lateral regions of said plate, wherein said central region is convex and said lateral regions are substantially planar;

ii) a stop positioned on each side of said central region to contact said central region and change the direction of its convexity.

iii) a handle part located at a first end of said plate for bringing said central region into contact with said stops;

with a second end of said resilient plate fastened to said sanding plate, such that said resilient plate snap swivels in response to direction of the convexity of said central region from a clamping position in which said first end of said resilient plate is proximate said sanding plate such that sandpaper can be clamped between said first end and said sanding plate, to a disengaged position in which said first end is remote from said sanding plate such that the sand paper can be removed from the sanding plate.

7. The clamping device in combination with a sanding plate of a vibration sander as defined in claim 6, wherein at least one of said stops is integral with said resilient plate.

8. The clamping device in combination with a sanding plate of a vibration sander as defined in claim 6, wherein said stops are formed as tongues, and at least one of said stops holding said second end of said resilient plate on the sanding plate.

9. The clamping device in combination with a sanding plate of a vibration sander as defined in claim 8, wherein said at least one stop forms a tab connection with said sanding plate.

* * * * *